United States Patent [19]

Pitman

[11] Patent Number: 5,026,102

[45] Date of Patent: Jun. 25, 1991

[54] MECHANICAL SECURITY DEVICE FOR DOORS

[76] Inventor: James Pitman, 1233 Commonwealth Blvd., Toms River, N.J. 08757

[21] Appl. No.: 448,229

[22] Filed: Dec. 11, 1989

[51] Int. Cl.[5] ..... E05C 9/00

[52] U.S. Cl. ..... 292/259 R; 292/44

[58] Field of Search ..... 292/44, 68, 259, 260, 292/45, 338

[56] References Cited

U.S. PATENT DOCUMENTS

| | | | |
|---|---|---|---|
| 116,626 | 7/1871 | Parsons et al. | 292/260 |
| 257,071 | 4/1882 | Richardson | 292/55 |
| 413,913 | 10/1889 | Blanchard | 292/260 |
| 611,743 | 10/1898 | Stevens | 292/44 |
| 843,730 | 2/1907 | Wittmann | 292/259 X |
| 886,090 | 4/1908 | Stryker | 292/259 |
| 956,329 | 4/1910 | Foster | 292/259 |
| 1,687,538 | 10/1928 | Bradbury | 292/259 |
| 1,942,732 | 1/1934 | Shepard | 292/259 |
| 1,989,781 | 2/1935 | Zak | 292/259 |
| 2,339,073 | 1/1944 | Hobson et al. | 292/45 |
| 3,980,328 | 9/1976 | Pearson | 292/256 |
| 4,067,598 | 1/1978 | Mansour | 292/259 |
| 4,082,332 | 4/1978 | Palmer | 292/259 |
| 4,179,999 | 12/1979 | Cotten | 105/377 |
| 4,322,101 | 3/1982 | Kelly et al. | 292/260 |
| 4,529,235 | 7/1985 | Florentine, Sr. | 292/259 R |
| 4,601,503 | 7/1986 | Wicks, Sr. | 292/259 R |

*Primary Examiner*—Eric K. Nicholson

*Attorney, Agent, or Firm*—Clifford G. Frayne

[57] ABSTRACT

A security apparatus for mounting on the interior side of a door and overlying the door to prevent the opening by intruders and characterized by its ability to absorb and transfer force utilized by potential intruders, the apparatus consisting of an elongate, rigid, arcuate crossbar mounted on brackets transversely across the door, the arcuate crossbar being positioned in either a concave or convex relationship to the door depending upon whether the door opened outwardly or inwardly, respectively, the crossbar communicating with the door and the adjacent walls to absorb and transfer force against the door to the adjoining walls.

5 Claims, 4 Drawing Sheets

MECHANICAL SECURITY DEVICE FOR DOORS

FIELD OF INVENTION

The present invention relates to a security apparatus for overlying a door to prevent the forcible entry therethrough by intruders and more particularly to a security apparatus capable of absorbing the heavy shock of attempted forced entry through the absorption and transference of said shock to the walls immediately adjacent the door.

BACKGROUND OF THE INVENTION

Burglary and theft through forced entry are concerns of not only the homeowner, but the businessman, and commercial tenant. The present invention, while having application to any standard solid, hinged door, is primarily designed for use by the businessman or commercial tenant which would have multiple doors to their facilities, some of which would be concealed on the rear of the building or in alley ways or streets which are not heavily traveled during the hours when commerical burglary and theft as a result of forced entry occur. Applicant's invention is primarily addressed to these concerns because of the construction and configuration of Applicant's invention.

Door bar systems have been in existence since the first individual placed a crossbeam behind a door to prevent its forced entry. As door security systems have advanced and become more complicated, the thief or burglar's ability to circumvent these security systems has also advanced. A variety of systems have been patented which attempt to prevent the entry, forced or otherwise, through a door. These include U.S. Pat. No. 3,980,328 to Pearson, U.S. Pat. No. 4,067,598 to Mansour, U.S. Pat. No. 4,082,332 to Palmer as well as a variety of latching devices including U.S. Pat. No. 4,179,999 to Cotton and U.S. Pat. No. 4,322,101 to Kelly.

All of the devices in question relate to some form of crossbar which provides extra support in integrity to the door to prevent its being forced open, the crossbars being secured to the adjacent walls by some means of bracketing device incorporating a lock mechanism. In some instances, such as in Pearson, the door bar system incorporates a locking cover for the doorknob itself.

Given sufficient time and ingenuity and tools, a burglar or thief may possibly overcome most security systems. Applicant's invention is directed towards a design which would require an extended period of time to overcome the system unless the thief or burglar resorted to excessive force to totally destroy the door in question and the surrounding door frame and wall. Applicant's security device, when coupled with an appropriate alarm system, would ensure that any tampering with the door which would set off the alarm would provide the police or other authority with sufficient time to reach the location in question before the door would be breached. Additionally, Applicant believes that its security device could not be breached by a potential burglar or thief without the use of excessive force over an extended period of time.

In many commercial burglaries and thefts, if the alarm can be activated and the thief or burglar experiences sufficient delay in entering the building, the robbery or burglary will be thwarted through abandonment or capture.

OBJECTS OF THE INVENTION

An object of the present invention is to provide for a door security mechanism which will prevent burglaries and thefts.

Another object of the present invention is to provide for a novel and unique door security mechanism which absorbs the impact of forced entry and thereby prevents such forced entry.

A still further object of the present invention is to provide for a novel and unique door security mechanism which is easily engaged and disengaged by the property owner, but not disengageable by a potential thief or burglar.

A still further object of the present invention is to provide for a novel and unique door security mechanism which secures the door by absorbing the impact of forced entry and spreading such impact to the adjacent door frame and walls.

A still further object of the present invention is to provide for a novel and unique door security mechanism which is operable from the interior of the door, regardless of whether the door opens inwardly or outwardly.

A still further object of the present invention is to provide for a novel and unique door security mechanism which can be mounted on the door or on the adjacent walls.

SUMMARY OF THE INVENTION

A security apparatus for mounting on the interior side of a door and overlying the door to prevent the opening by intruders and characterized by its ability to absorb and transfer force utilized by potential intruders, the apparatus consisting of an elongate, rigid, arcuate crossbar mounted on brackets transversely across the door, the arcuate crossbar being positioned in either a concave or convex relationship to the door depending upon whether the door opened outwardly or inwardly, respectively, the crossbar communicating with the door and the adjacent walls to absorb and transfer force against the door to the adjoining walls.

BRIEF DESCRIPTION OF THE DRAWINGS

These and other advantages and improvements will be evident especially when taken with the following drawings where.

DETAILED DESCRIPTION OF THE DRAWINGS

Figure 1:
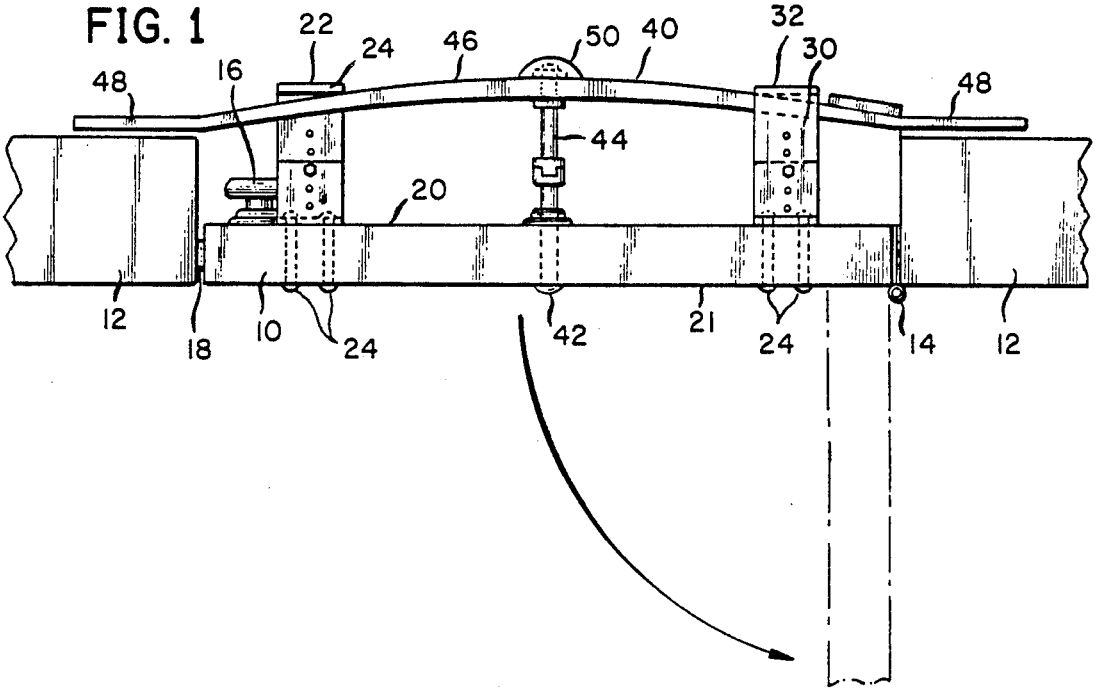
FIG. 1 is a top view of the door security mechanism secured to a door which opens outwardly from the building.

Referring to FIG. 1, there is shown a top vieW of the security mechanism secured to a solid door which would open outwardly from the building. Door 10 is secured in the wall of the building 12 and mounted by means of a hinge 14. In the configuration shown in FIG. 1, door 10 is of the type which is designed to be opened only from the inside of the building, hence, a single doorknob 16 positioned on the door. The lock mechanism 18 associated with door 10 would typically be associated with doorknob 16 and engage the respective wall 12 immediately adjacent doorknob 16. A thief or burglar attempting to gain forced entry through door 10 would address either hinge 14 or lock mechanism 18 in an effort to pry door 10 from its position and gain entry into the building. In doing so, the thief or burglar would attempt to exert force on door 10 in order to pry the door 10 outwardly from the building.

Applicant's security mechanism would be secured to the door on its interior side 20. The security mechanism consists of a first mounting bracket 22 mounted to the interior side 20 of door 10 by means of threaded bolts 24 which extend from the exterior side 21 of door 10 to the interior side 20. Threaded bolts 24 support bracket 22 in a substantially perpendicular position to the interior side 20 of door 10 with bracket 22 having an upstanding retainer face 24 for cooperation with the spring latch as described hereafter.

A second mounting bracket 30 is mounted on interior side 20 of door 10 proximate to the opposing wall 12, securing door 10. Second mounting bracket 30 is again secured to the interior side 20 of door 10 by means of threaded bolts 24 which extend through door 10. Second mounting bracket 30 has a depending latch retainer face 32 for cooperation with the spring latch as described hereafter. Second mounting bracket 30 is again substantially perpendicular to the interior wall 20 of door 10.

Centrally positioned on door 10, on its interior surface, is spring latch 40. Spring latch 40 is secured by means of a threaded bolt 42 which extends through door 10. Threaded bolt 42 has a washer-nut mechanism secured to it on the interior side 20 of door 10 to which a shaft 44 is secured. Shaft 44 extends perpendicular away from inner surface 20 of door 10. Spring latch 40 is secured to the end of shaft 44 by means of lock nuts, spring latch 40 being rotatable on shaft 44.

Spring latch 40 comprises an arcuate arm portion 46 having substantially planer end portions 48. Arcuate arm section 46 has an aperture 50 centrally positioned therethrough for cooperation with shaft 44 for the mounting of spring latch 40. In the configuration shown in FIG. 1, with door 10 opening outwardly from the building, spring latch 40 is positioned such that arcuate arm 46 is in concave relationship with the interior surface 20 of door 10. Planer end portion 48 of spring latch 40 are designed to engage and disengage the interior surface of walls 12, immediately adjacent door 10.

Figure 2:
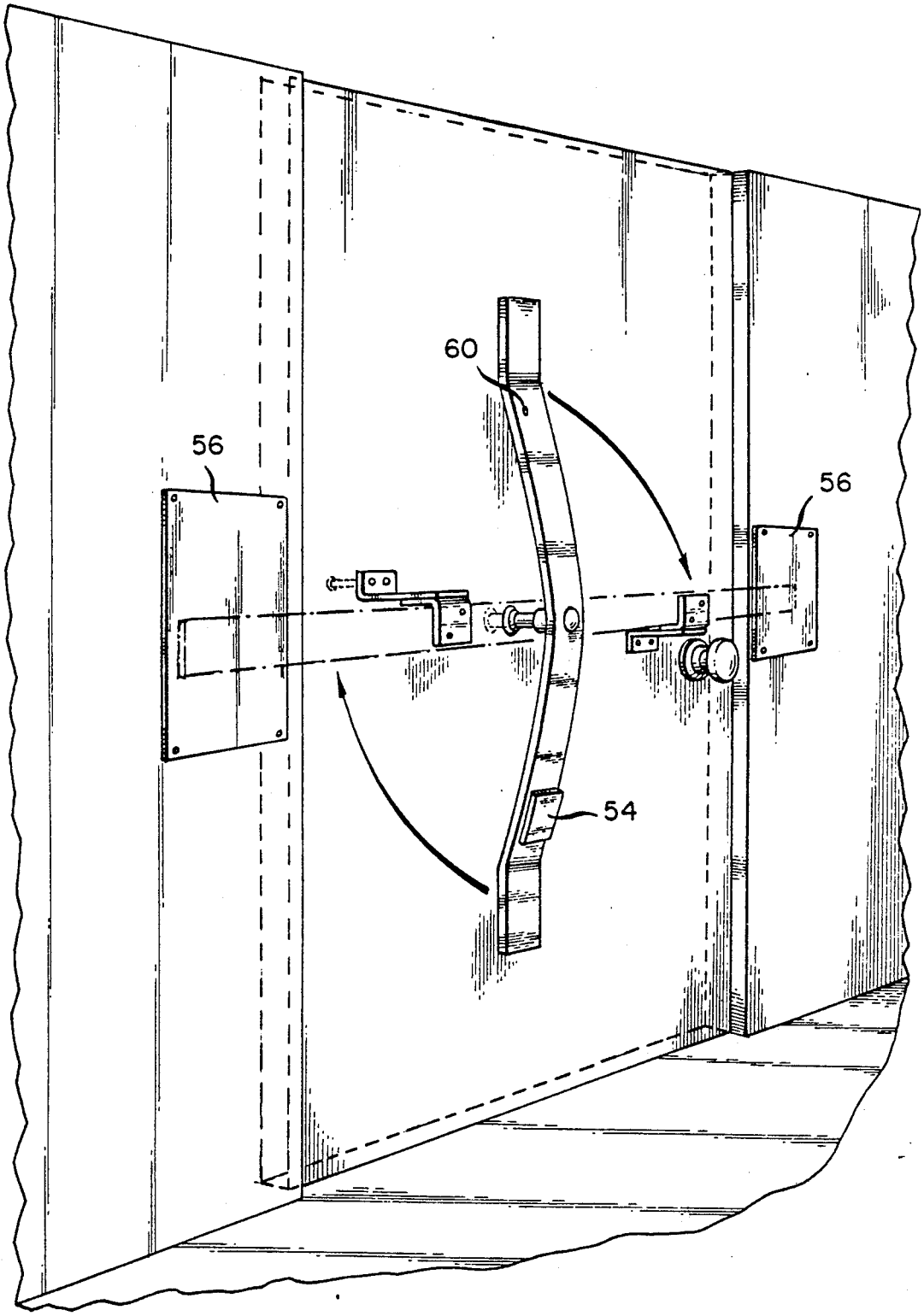
FIG. 2 is a top view of the door security mechanism secured to a door which opens inwardly on the building.

FIG. 2 is a perspective view of door 10 with spring latch 40 positioned in the disengaged position. In this configuration, spring latch 40 has been rotated 90° clockwise from its horizontal position. As such, planer end portions 48 have disengaged the interior surface of walls 12 and the arcuate arm portion 46 of spring latch 40 has become disengaged from brackets 22 and 30. Spring latch 40 would be maintained in this vertical position by means of counterweight 54 secured proximate to one end of arcuate arm 46, proximate to planer end portion 48. In a disengaged position as shown in FIG. 2, the owner, operator or occupants of the building could utilize door 10 for ingress or egress.

In securing door 10 against forced entry, the owner or operator would rotate spring latch 40 in a clockwise position, 90° until arcuate arm 46 engaged brackets 22 and 32, respectively which would effectively halt the rotation of spring latch 40. Planer end portions 48 would then be positioned and extend beyond the inner surface 20 of door 10 and engage the interior surface of walls 12 immediately adjacent door 10. As can be seen in FIG. 2, an optional element of Applicant's invention would be a substantially rectangular skid plate 56 mounted on opposing sides of door 10 on the inner surface of wall 12 to engage the planer end portions 48 of spring latch 40 and prevent damage to the wall. Additionally, a plurality of aligned apertures 60, in arcuate arm 40 and upstanding arm 24 of bracket 22 or depending arm 32 of bracket 30 could accommodate a locking device.

In this configuration, door 10 is secured from forced entry. Attempts to pry door 10 open from the exterior, will transfer such applied force through shaft 44 to spring latch 40. Spring latch 40 in cooperation with brackets 22 and 30 would transfer such exterior force to the planer end portions 48 and hence wall 12. As such, the intended thief or burglar, in attempting to apply force against door 10 either at the lock means 18 or at the hinge means 14, finds himself working against spring latch 40 and the adjacent walls 12 of door 10. The force expended on door 10 is transferred and absorbed by spring latch 40.

Figure 3:
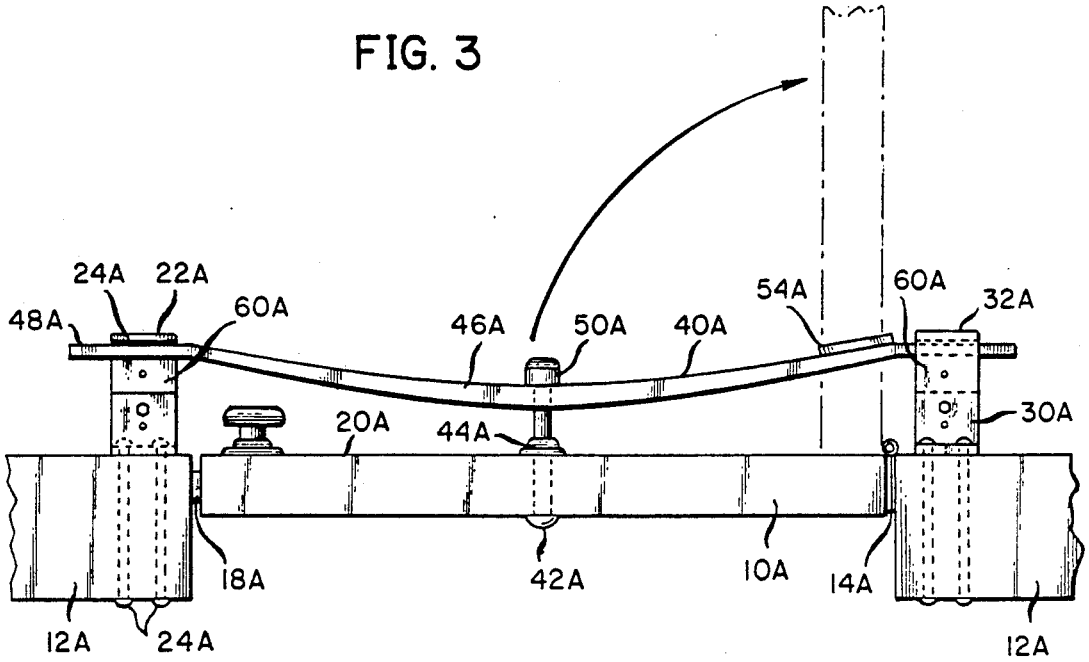
FIG. 3 is a perspective view of the door security mechanism secured to a door which opens outwardly from the building.

FIG. 3 is a top view of the security mechanism secured to a door which would open inwardlY from the building. Door 10A is secured in the wall of the building 12A and mounted by means of hinge 14A. In the configuration shown in FIG. 3, door 10A is of the type which is designed to be opened only from the inside of the building, hence, a single doorknob 16A positioned on the door. The lock mechanism 18A associated with door 10A would typically be associated with doorknob 16A and engage the respective wall 12A immediately adjacent doorknob 16A. A thief or burglar attempting to gain forced entry through door 10A would address either hinge 14A or lock mechanism 10A in an effort to force the door 10A inwardly into the building.

Applicant's security mechanism would be secured to the door on its interior side 20A. In this embodiment, a first positioning bracket 22A would be secured to the interior of wall 12A by means of threaded bolts 24A which would extend through wall 12A. First positioning bracket 22A would have an upstanding retainer face 24A for cooperation with the spring latch as described hereafter.

A second mounting bracket 30A would be positioned on the interior face of wall 12A opposite first mounting bracket 22A. Second mounting bracket 30A is again secured to the interior surface by means of threaded bolts 24A which extend through wall 12A. Second mounting bracket 30A has a depending latch retainer face 32A for cooperation with the spring latch as described hereafter.

Centrally positioned on door 10A on its interior surface is spring latch 40A. Spring latch 40A is secured by means of a threaded bolt 42A which extends through door 10A. Threaded bolt 42A has a washer-nut mechanism secured to it on the interior side 20A of door 10A to which shaft 44A is secured. Shaft 44A extends perpendicularly away from inner surface 20A of door 10A. Spring latch 40A is secured to the end of shaft 44A by means of lock nuts, spring latch 40A being rotatable on shaft 44A.

Spring latch 40A comprises an arcuate arm portion 46A having substantially planer end portions 48A. Arcuate arm section 46A as an aperture 50A centrally positioned therethrough for cooperation with shaft 44A for the mounting of spring latch 40A. In the configuration shown in FIG. 3, with door 10A opening inwardly from the building, spring latch 40A is positioned such that arcuate arm 46 is in convex relationship with the interior surface 20A of door 10A. The planer end portions 48A of spring latch 40A are designed to engage and disengage upwardly depending retainer face 24A and downwardly depending retainer 32A in mounting brackets 22A and 30A, respectively.

As shown in FIG. 3, spring latch 40A is in the locked position. Spring latch 40A could be maintained in this position by means of a series of aligned apertures 60A in planer end portions 48A of spring latch 40A which would align with apertures in mounting brackets 22A and 30A. In its disengaged position, the spring latch 40A as shown in FIG. 3 would be rotated ninety degrees and maintained in that position by means of counterweight 54A.

In this configuration, a thief or burglar attempting to gain entry through door 10A by forcing door 10A inwardly will cause planer end portions 48A of spring latch 40A to engage mounting brackets 22A and 30A. As such, the force expended will be transferred to spring latch 40A which in turn will absorb some of the force because of its convex positioning with respect to the door. Additionally, the force will be transferred to planer end portions 48A of spring latch 40A and, in turn, to mounting brackets 22A and 30A and thus to the wall of the building immediately adjacent the door. In this configuration, the force expended on the door by the intended thief or burglar is absorbed and transferred by spring latch 40A.

Figure 5:
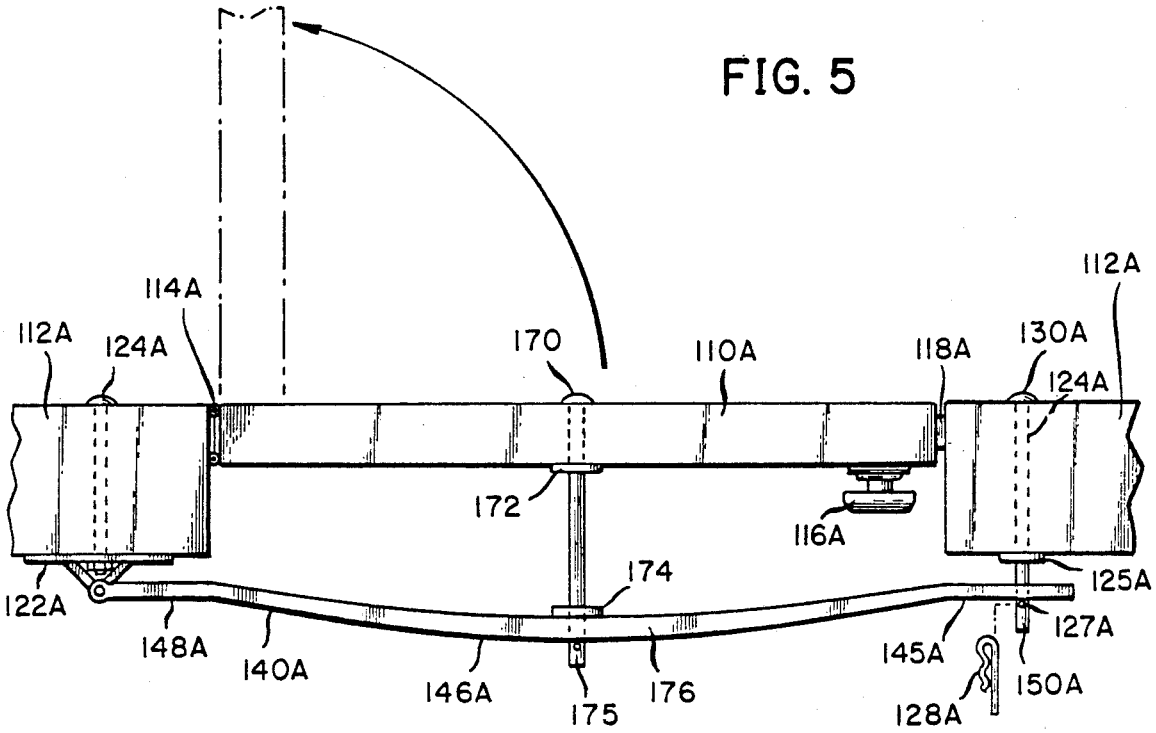
FIG. 5 is a top planer view of the second embodiment of the invention positioned for an outwardly opening door.
Figure 6:
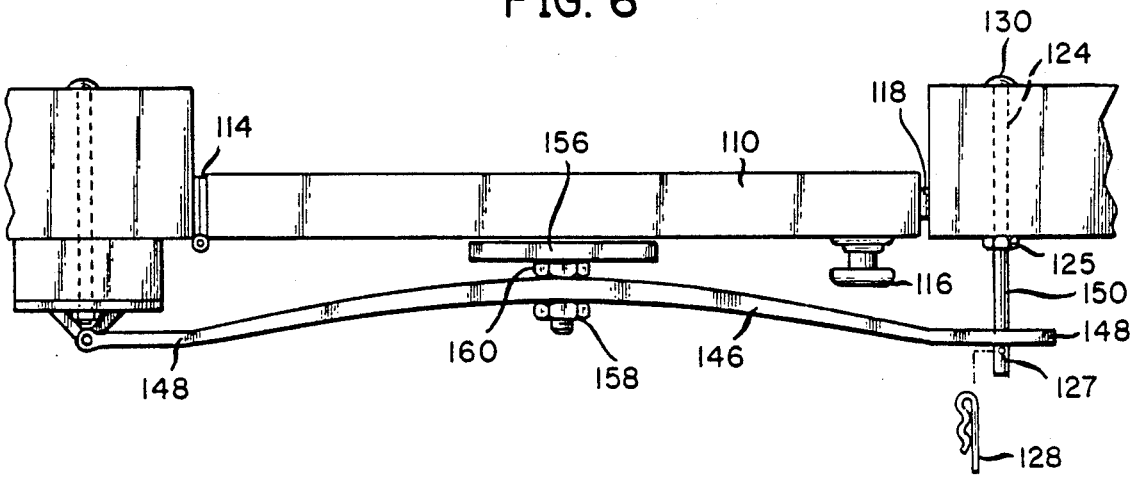
FIG. 6 is a top planer view of the second embodiment of the invention positioned for an inwardly opening door.

A second embodiment of the security mechanism provides the same advantages as the first embodiment. The second embodiment as shown in FIGS. 4, 5 and 6, details the security mechanism which is hingeably secured to the wall adjacent to the door such that it can be disengaged from its locking position by swinging it away from the door and engaged in its locking position by swinging it towards the door and across the door.

Figure 4:
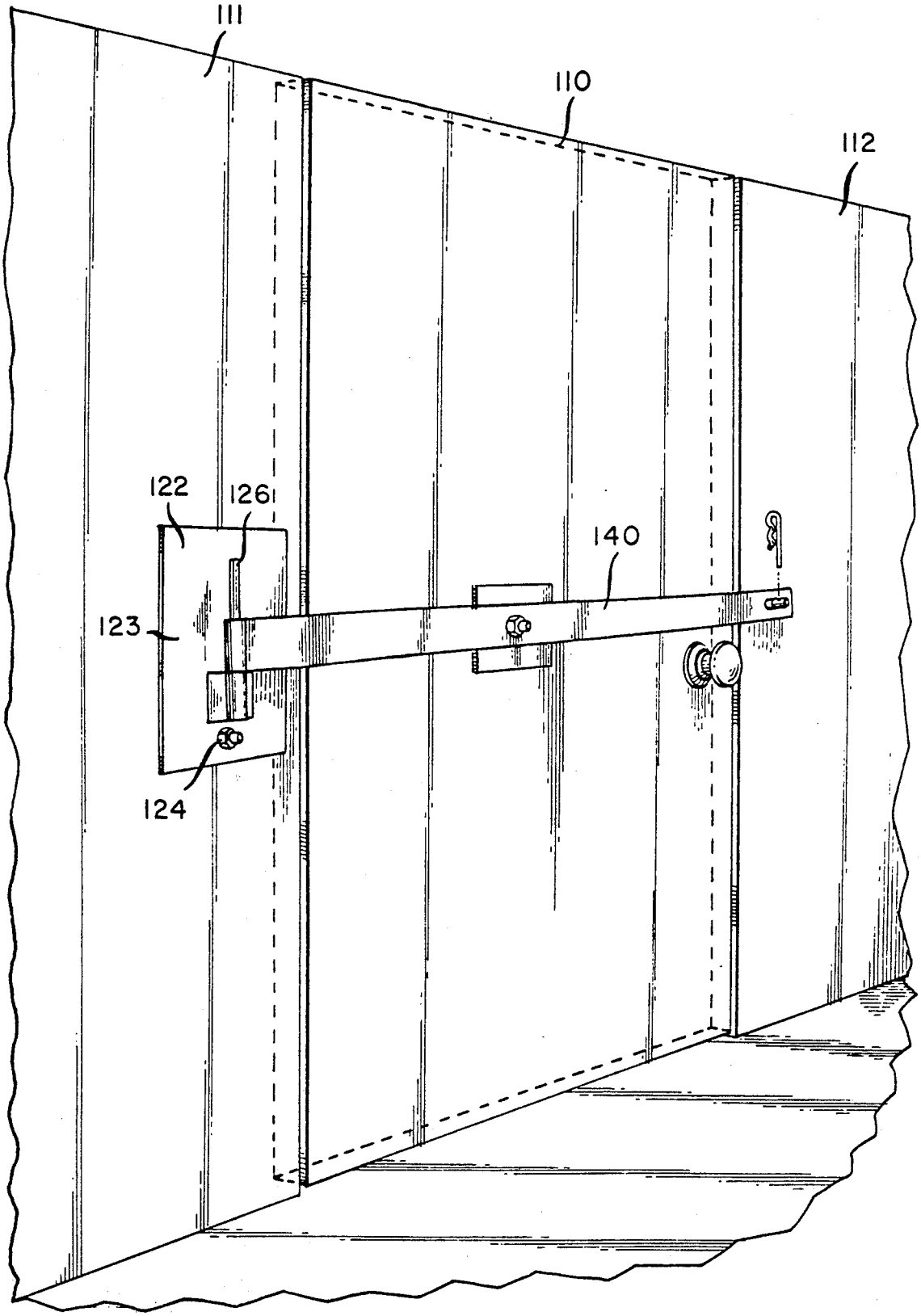
FIG. 4 is a perspective view of a second embodiment of the invention showing the door security mechanism operational from a mounting system on the wall adjacent to the door.

Referring to FIG. 4, there is shown a perspective view of a second embodiment of the security mechanism in conjunction with an inwardly opening door.

Inwardly opening door 110 is secured within a door frame secured to the wall of the building 112. The configuration shown in FIG. 4 shows a door 110 which would swing inwardly into the building. FIG. 6, which is a top planer view of the security mechanism secured to door 100 which would swing inwardly, shows that door 110 is mounted by means of hinges 114 within the door frame and would have a single doorknob 116 associated with a lock mechanism 118. Lock mechanism 118 in conjunction with doorknob 116 would normally serve to lockingly engage door 110 with wall 112 immediately adjacent door 110. As shown in FIGS. 4 and 6, the security mechanism is positioned on the interior side 120 of door 110. Security mechanism comprises a first mounting bracket 122 secured to wall 112 adjacent hinges 114 on door 110. First mounting bracket 112 is shown in this embodiment in the form of a plate 123 secured through wall 112 by threaded fasteners 124, first mounting bracket 122 having a vertical hinged mechanism 126 secured thereto. Second mounting bracket 130 is secured in opposite wall 112 adjacent to locking mechanism 118 of door 110. Second mounting bracket 130 consists of a mounting bolt 124 extending through wall 112 and secured by means of a locking nut 125 to prevent its removal from the exterior of the building. Threaded fastener 124 extends inwardly into the room and has positioned proximate its outermost extent, an aperture 127 for receipt of a locking pin 128.

The security mechanism comprises a spring latch 140 hingeably mounted on first mounting bracket 122. Spring latch 140 comprises an arcuate arm portion 146 and planer end portions 148. In the configuration shown herein, arcuate arm portion 146 of spring latch 140 is convex with respect to its relationship to door 110. Planer end portion 148, opposite first mounting bracket 122 has an aperture 150 therethrough to permit engagement with threaded bolt 124 of second mounting bracket 130. In this configuration, spring latch 140 can be swung away from door 110 and positioned adjacent wall 112 when not engaged, and swung across door 110 such that aperture 150 engages threaded bolt 124 by means of aperture 150 and is locked into position by means of cotter pin or locking pin 128.

Centrally positioned on spring latch 140 on arcuate arm section 146 is an engaging plate 156. Engaging plate 156 is centrally positioned on arcuate arm section 146 by means of locking nuts 158 and arm 160. Engaging plate 156 is positioned between arcuate arm section 146 and door 110 such that engaging plate 156 is in proximate contact with door 110.

In this configuration, with spring latch 140 engaged with second mounting bracket 134 and locking pin 128 in position, a thief or burglar attempting to secure forced entry through door 110 would engage the security mechanism. In this configuration, a thief or burglar attempting to gain entry through door 110 by forcing door 110 inwardly will cause door 110 to engage engaging plate 156. As such, the force expended by the thief or burglar will be transferred to engaging plate 156 and thus to spring latch 140 by means of the convex arcuate section 146. The force will then be transferred and absorbed to first mounting bracket 122 and second mounting bracket 130 which will transfer and absorb the force utilized by the thief or burglar to the walls 112 immediately adjacent door 110.

Referring to FIG. 5, there is shown a second embodiment of the security mechanism utilized with respect to an outwardly opening door. In this configuration, door 110A is secured in a door frame in wall 112A by means of hinged mechanism 114A. Door 110A has a single doorknob 116A associated with a lock mechanism 118A which engages wall 112A immediately adjacent doorknob 116A. In this configuration, first mounting bracket 122A is positioned on the interior of wall 112A by means of threaded fasteners 124A which extend through wall 112A. Second mounting bracket 130A is mounted on the opposite wall 112A and comprises a threaded fastener 124A which extends through wall 112A and is secured by a lock nut 125A on the interior of wall 112A. Threaded fastener 124A extends into the interior of the room and has an aperture 127A proximate to its longitudinal end for engagement with a security mechanism as described hereafter.

In this configuration for an outwardly opening door, a locking arm 170 is centrally positioned on door 110A by means of a locking nut 172. Arm 170 extends inwardly to the interior of the room and has a stop nut 174 positioned proximate to its end and an aperture 175 positioned through arm 172 proximate to its interior end.

The security mechanism again comprises a spring latch 140A hingeably mounted on first mounting bracket 122 and designed to swing in a horizontal plane across door 110A. Spring latch 140A comprises an arcuate arm section 146A and planer end portions 148A. An elongated opening 176 is positioned centrally on arcuate arm section 146A and an aperture 150A is positioned on the planer end portion 148A of spring latch 140A opposite first mounting bracket 122A. Spring latch 140A may be swung into its engaged locking position with elongated aperture 176 permitting arcuate arm section 146A to engage arm 170 and aperture **150*a* to engage second mounting bracket 130A. A locking pin 128A would then engage the spring latch 140A in a locking position by being positioned through aperture 127A in second mounting bracket 130A and aperture 175 in locking arm 170**.

A thief or burglar attempting forced entry through door 110A by attempting to pry door 110A outwardly would have the force of the attempted entry transferred by means of arm 170 to arcuate arm section 146A and thence to mounting brackets 124A and 130A. In this configuration, the force thus utilized would be transferred and absorbed through arcuate arm section 146A and walls 112A adjacent to door 110A.

The objects and advantages of the second embodiment of this invention are identical to the first embodiment. The second embodiment utilizes the same concepts as the first embodiment, but allows for the security mechanism to be hingeably mounted adjacent to the door as opposed to being centrally mounted on the door itself.

As stated, Applicant's invention has application to any door of a solid nature such as industrial or commercial metal doors. Applicant's invention is designed to absorb the force utilized by a would-be thief or burglar in attempting to traverse the door and to transfer the force utilized by the burglar to the walls adjacent to the door to provide further support.

While the present invention has been described in connection with the exemplary embodiment thereof, it will be apparent to those of ordinary skill in the art that this application is intended to cover any adaptations or variations thereof. Therefore, it is manifestly intended that this invention be only limited by the claims and the equivalents thereof.

I claim:

1. A security apparatus for mounting on the interior side of a door and overlying said door to prevent the opening thereof by intruders and characterized by its ability to absorb a forcible battering of said door and transfer said forcible battering to adjacent walls, said security apparatus comprising:

an elongate, rigid, arcuate crossbar having a length sufficient to extend transversely across and beyond said door opening, said crossbar being concave in its respective position to said door for said door opening inwardly and said crossbar being convex with respect to its position to said door for said door opening outwardly, said crossbar having planer longitudinal end portions for engagement with said adjacent walls to said door opening, said crossbar being rotatably secured to said door;

a pair of brackets for engaging said crossbar in a secure position, one of said brackets having a depending lip and said opposing bracket having an upstanding lip, said brackets having a series of apertures coincidental with apertures in said crossbar for locking said crossbar in a horizontal transverse position securing said door.

2. A securing apparatus in accordance with claim 1 wherein said engaging brackets for said elongate, rigid, arcuate crossbar are mounted on said door for said crossbar being concave with respect to said door opening inwardly.

3. A securing apparatus in accordance with claim 1 wherein said mounting brackets are mounted on said wall adjacent said door opening for said elongate, rigid, arcuate crossbar being convex with respect to said door opening outwardly.

4. A securing apparatus in accordance with claim 1 wherein said crossbar comprises a counterweight, mounted proximate to one longitudinal end of said crossbar to maintain said crossbar in a vertical nonsecure position when not in use.

5. A securing apparatus in accordance with claim 1 wherein said planer longitudinal ends of said crossbar engage a skid plate mounted on opposing sides of said door opening when said crossbar is in said secure position.

* * * * *